US006279198B1

(12) United States Patent
Martin et al.

(10) Patent No.: US 6,279,198 B1
(45) Date of Patent: Aug. 28, 2001

(54) CONVERTIBLE WET/DRY CLEANING SYSTEM

(75) Inventors: Michael F. Martin, St. Charles; Jeffrey L. Young, St. Peters, both of MO (US)

(73) Assignee: Emerson Electric Co., St. Louis, MO (US)

( * ) Notice: Subject to any disclaimer, the term of this patent is extended or adjusted under 35 U.S.C. 154(b) by 0 days.

(21) Appl. No.: 09/252,382

(22) Filed: Feb. 18, 1999

(51) Int. Cl.[7] ..... A47L 9/06

(52) U.S. Cl. ..... 15/393; 15/400; 15/401; 15/414; 15/415.1; 15/367

(58) Field of Search ..... 15/400, 401, 414, 15/415.1, 393, 365, 367

(56) References Cited

U.S. PATENT DOCUMENTS 2,703,903 * 3/1955 Faith-Ell ..... 15/367
3,069,716 * 12/1962 Smith ..... 15/365
4,475,265 * 10/1984 Berfield ..... 15/401
5,706,550 * 1/1998 Holsten et al. ..... 15/400
5,819,366 * 10/1998 Edin ..... 15/367

* cited by examiner

*Primary Examiner*—Robert J. Warden, Sr.
*Assistant Examiner*—Theresa T. Snider
(74) *Attorney, Agent, or Firm*—Howrey Simon Arnold & White LLP

(57) ABSTRACT

A multi-use floor tool, with which the same nozzle can be used in both dry and wet vacuum operation, and which allows for both wet and dry cleaning attachments to be easily attached and removed is disclosed. One such cleaning attachment for dry operation is a bristle brush which, when attached to the nozzle, is able to rotate, such that debris is collected with both the push and pull cleaning motions and such that for each motion, air flows primarily through the side of the nozzle at which debris is being gathered. The attachment for wet operation is a squeegee, which is rigidly attached to the nozzle having an insert which reduces the area of air flow into the nozzle and thereby increases the effectiveness of wet cleaning. This design increases the effectiveness of both wet and dry operation, and allows the operator to effectively clean in both wet and dry conditions while using the same nozzle.

3 Claims, 11 Drawing Sheets

CONVERTIBLE WET/DRY CLEANING SYSTEM

BACKGROUND OF THE INVENTION

1. Field of the Invention

The present invention relates generally to a multi-use floor tool and, more particularly, to a vacuum nozzle and attachments which can be utilized for both wet and dry operation.

2. Description of the Related Art

With the advent of the wet/dry vacuum, consumers became able to clean a multitude of areas of their home or business, and multiple types of both wet and dry debris by using only one device. This technology thus allowed consumers to clean both wet and dry areas, without having to purchase separate machines. However, in most wet/dry cleaning operations, in order for an operator to transfer from wet to dry operation of a vacuum, the operator had to switch nozzles, for example, from a bristle-brush nozzle to a squeegee nozzle, in order to get the most effective cleaning results. This resulted in a numerous amount of parts which had to be manufactured, bought and stored.

For dry operation, many wet/dry vac nozzles have a bristle strip positioned just behind the brush nozzle's inlet. This results in the bristle only being effective in sweeping debris during the forward cleaning stroke, rather than the backward stroke as well. Other types of brush nozzles had only a formed brush surrounding the bottom portion of the nozzle. In many cases, this brush was trimmed only on one side, which allowed the brush to effectively pick up debris only when moved in one direction. Other brush nozzles had reliefs cut around the perimeter of the brush which allowed for debris pickup in both sweeping directions, but these designs did not redirect full air flow to the side of the brush accumulating debris.

Therefore, there is a need for a single nozzle assembly that can be effectively used during both wet and dry operation and that can be easily transferred between wet and dry operational modes. There is also a need for a vacuum brush nozzle, in dry operation, which can effectively pick up debris during both the forward and backward strokes, by redirecting the full air flow of the nozzle to the particular side of the brush accumulating debris at the time.

SUMMARY OF THE INVENTION

The present invention is directed toward a multi-use floor tool that addresses at least some of the needs as expressed above. It includes a nozzle housing adapted to be coupled to a vacuum device, and designed to receive various cleaning attachments which can be easily attached and removed. The nozzle housing can also be used for cleaning without any attachments inserted. The present invention also includes a vacuum assembly having such attachments and features.

One cleaning attachment is a brush attachment for dry operation, having a brush head which can quickly and easily be attached to and detached from the nozzle housing and a plurality of bristles that protrude from the brush head. Another such cleaning attachment is a squeegee attachment for wet operation, having a squeegee head which can quickly and easily be attached to and detached from the nozzle housing, and a squeegee body that protrudes from the squeegee head. A nozzle insert can be used with the squeegee attachment. This nozzle insert latches onto the bottom of the nozzle housing and has the effect of reducing the surface area of air flow into the nozzle housing and thereby increasing the effectiveness of wet suction. The above-referenced cleaning attachments should also be of a sufficient length that they protrude slightly from the bottom of the housing when attached, so as to effectively engage the floor or other surface during cleaning operation.

The nozzle housing is able to be attached to a vacuum device and contains openings on its bottom and top such that air is allowed to flow through the nozzle housing when the vacuum is operating. It also comprises a latching means such that the head of a cleaning attachment can be easily attached and removed such that the same nozzle housing can be used with various cleaning attachments during wet and dry operation. The nozzle can also contain a plurality of recesses inside of its bottom opening such that it can receive a nozzle insert effectively reducing the open surface area of the bottom opening.

The brush attachment consists of a brush head having a plurality of bristles attached to and laterally protruding from the brush head. These bristles, when the attachment is attached to the nozzle housing, should protrude out of the bottom of the nozzle housing so as to contact the surface being cleaned. The brush head is rotatably attached to the snap inside the nozzle housing such that the brush attachment, when pushed or pulled, can rotate around its longitudinal axis. This rotation is blocked when the bristles of the attachment come into contact with a bottom side of the nozzle. This allows the nozzle to be effective during both the push and pull cleaning motions, and forces the vacuum's suction to flow through the side of the nozzle that is collecting debris during that motion.

The squeegee attachment is comprised of a squeegee head which can be attached to the snap in the nozzle head, and has a resiliently flexible squeegee body which laterally protrudes from the squeegee head. When the squeegee attachment is connected to the nozzle housing, the squeegee body should slightly protrude out of the bottom of the nozzle housing so as to contact the surface being cleaned. The squeegee attachment can also consist of a nozzle insert which has an elongate hole in its center. The squeegee body protrudes through this hole when the squeegee insert is attached to the bottom of the nozzle housing. The nozzle insert fits inside of the bottom of the nozzle, and snaps into place using tabs on the outside of the insert, which fit into corresponding recesses inside of the nozzle housing. The nozzle insert has the effect of decreasing the area of air flow through the bottom of the nozzle and thereby increasing the effectiveness of wet operation.

The net result of this disclosure is a multi-use floor tool which is effective for both wet and dry vacuum operation and which can be used in either wet or dry mode without having to replace the entire nozzle housing, merely a cleaning attachment Therefore, one object of the invention is to allow either wet or dry operation of a vacuum device while utilizing the same nozzle housing. This results in lower manufacturing costs, as well as ease to consumers because they do not have to purchase different nozzles for each mode of operation, and can quickly and easily switch from wet to dry operation.

Another object of the invention is to provide more effective cleaning operation in dry mode by allowing the vacuum to effectively pick up debris during both the push and pull strokes of the cleaning motion. It is also allows the user to utilize the full air flow of the vacuum during either of these motions by attaching the brush assembly to the nozzle housing, and allowing the brush to rotate with each push and pull motion, thereby restricting air flow through the nozzle to the side of the brush that is collecting debris during that particular motion.

BRIEF DESCRIPTION OF THE DRAWINGS

These and other objects and advantages of the present invention are hereinafter set forth and explained with reference to the drawings, wherein.

DETAILED DESCRIPTION OF THE INVENTION

Illustrative embodiments of the invention are described below. In the interest of clarity, not all features of an actual implementation are described in this specification. It will of course be appreciated that in the development of any such actual embodiment, numerous implementation-specific decisions must be made to achieve the developers'specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

Figure 1:
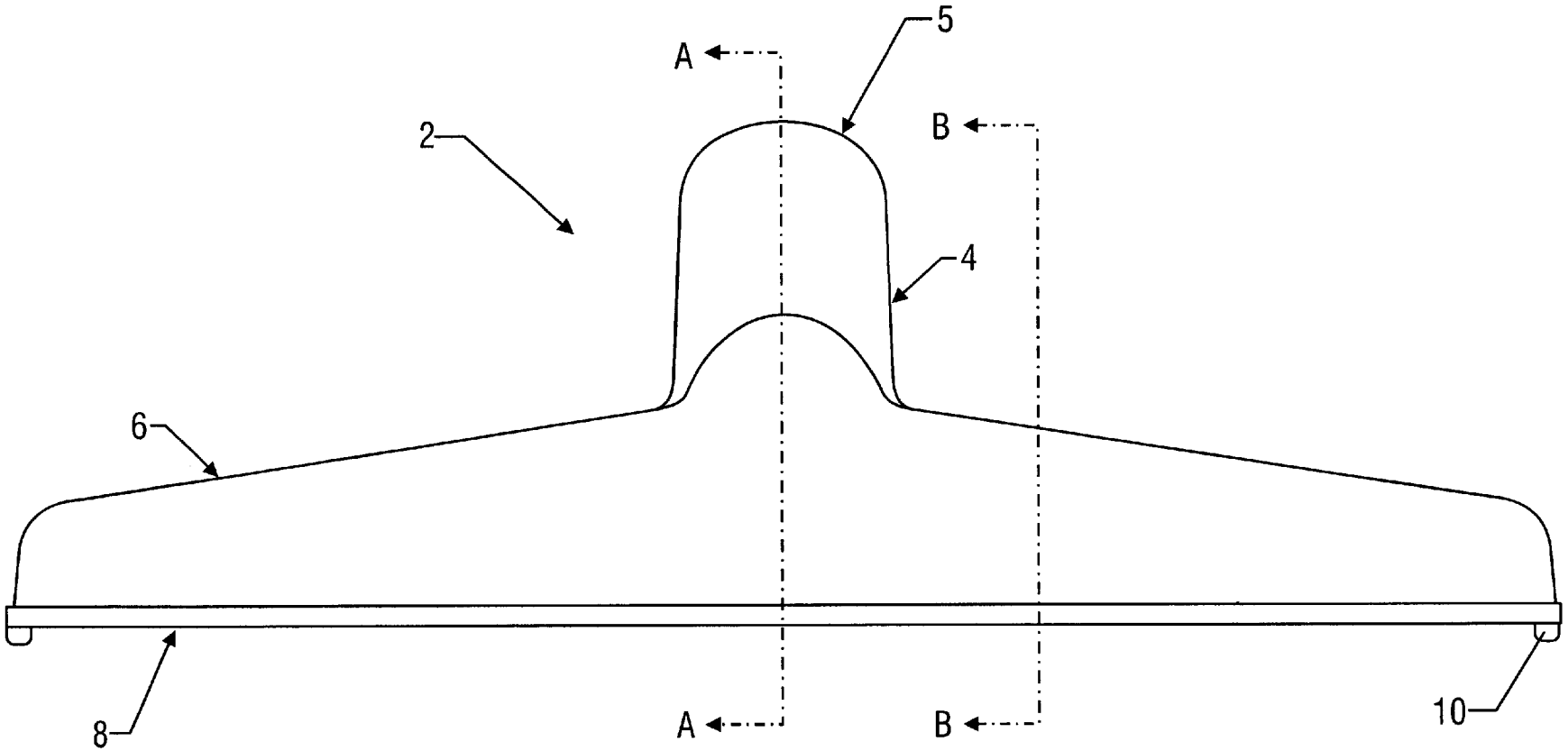
FIG. 1 is a front elevation view of the nozzle housing with no attachment inserted.

In FIG. 1, a nozzle housing 2 for a multi-use floor tool, in accordance with an embodiment of the present invention, is generally indicated, comprising a nozzle head 4 that is able to attach to a vacuum or suction device (not shown), and having attached at its other end an elongated nozzle body 6. These components may be made up of a metal or polymer material. Nozzle housing 2 has an open bottom surface area 8 such that air and other materials can travel through nozzle housing 2 and into the suction device. In one embodiment, nozzle housing 2 has a length and width of its bottom surface 8 such that its bottom surface area is larger than that of top opening 5 of nozzle head 4. For example, the bottom opening 8 may be 10 inches in length and 0.7 inches in width. An embodiment of nozzle housing 2 also comprises a lip 10 at the bottom of each of its longitudinal ends.

Figure 2:
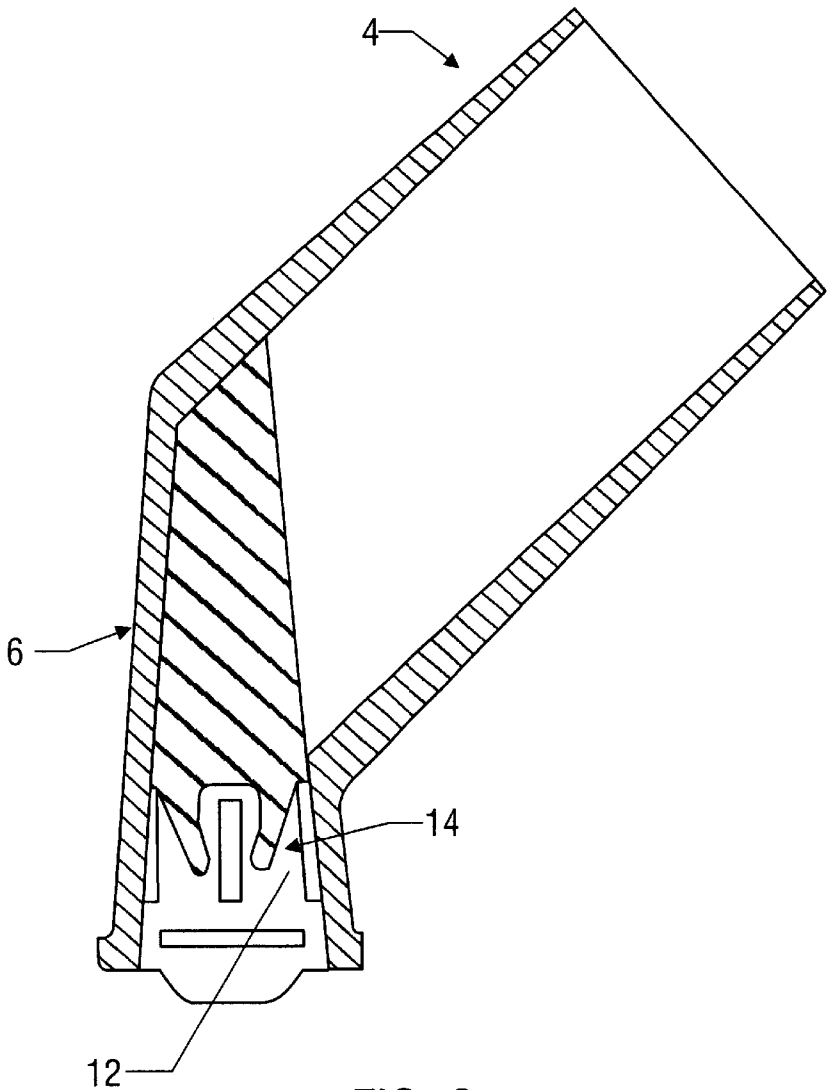
FIG. 2 is a side cross-sectional view of the nozzle housing with no attachment inserted.

As shown in FIG. 2, nozzle housing 2 comprises a snap 12 connected to said housing 2. An embodiment of snap 12 comprises a plurality of flexible extensions 14 shaped such that the head of a cleaning attachment (not shown) can be easily attached to and removed from the nozzle housing 2. Snap 12 is preferably comprised of two resiliently flexible extensions 14 attached to the inside top of the nozzle body 6. However, other configurations can be utilized which allow a cleaning attachment to be connected to and removed from said housing. Thus, attachment and removal of cleaning attachments can be achieved by pushing the head of said cleaning attachment through the opening provided between the two extensions.

Figure 3:
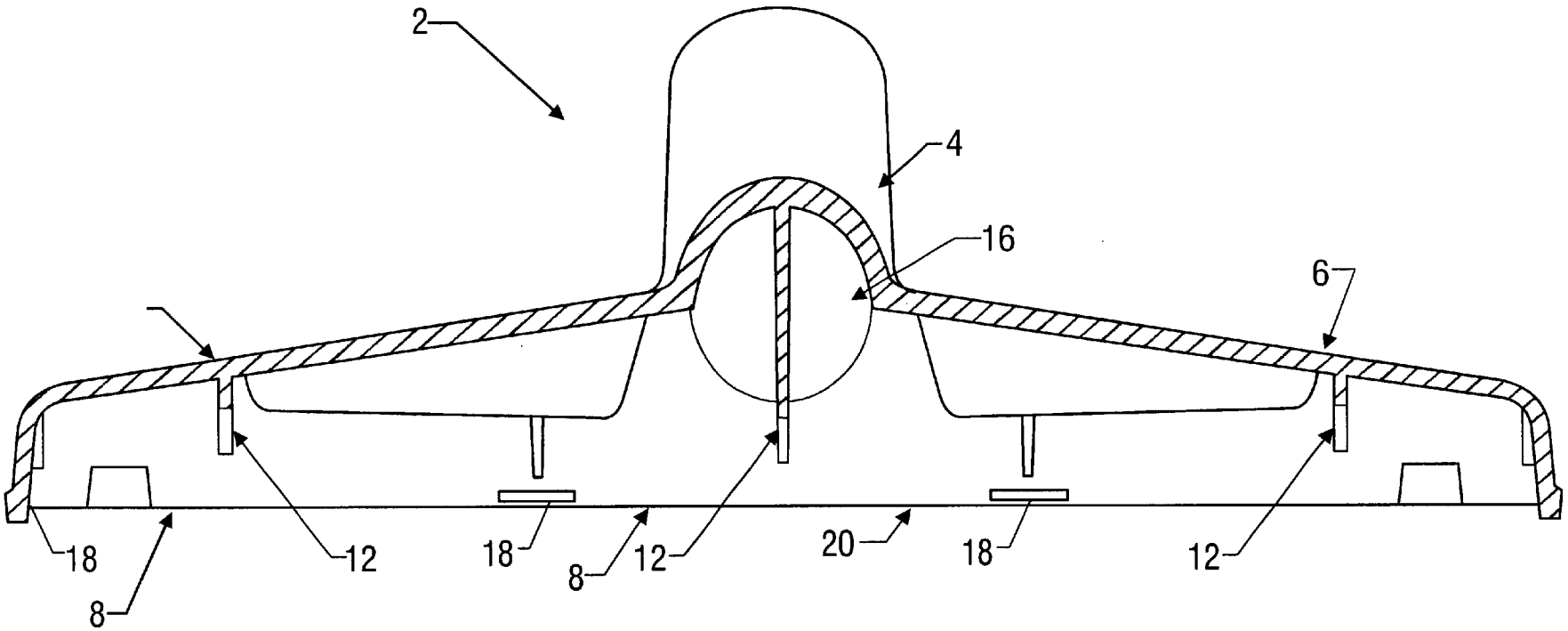
FIG. 3 is a front cross-sectional view of the nozzle housing with no attachment inserted.

As shown in FIG. 3, nozzle housing 2 also comprises an opening 16 such that air flows into the bottom 8 of nozzle body 6, into said nozzle head 4 through opening 16, and into a suction device. An embodiment of nozzle body 6 also comprises a plurality of recesses 18 set into the inner sides 20 of nozzle body 6 such that a cleaning attachment can be snapped into and out of body 6 through the bottom 8 of the nozzle housing.

Figure 5:
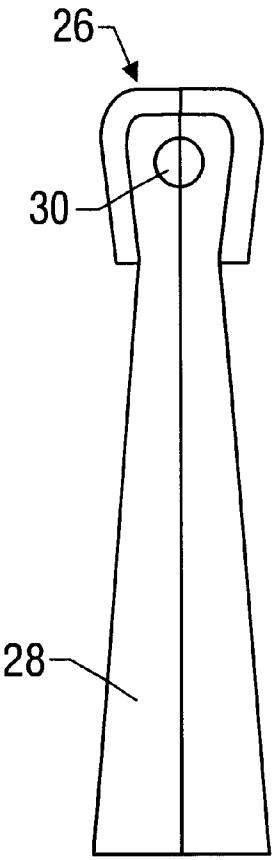
FIG. 5 is a side cross-sectional view of an embodiment of the brush attachment.
Figure 4:
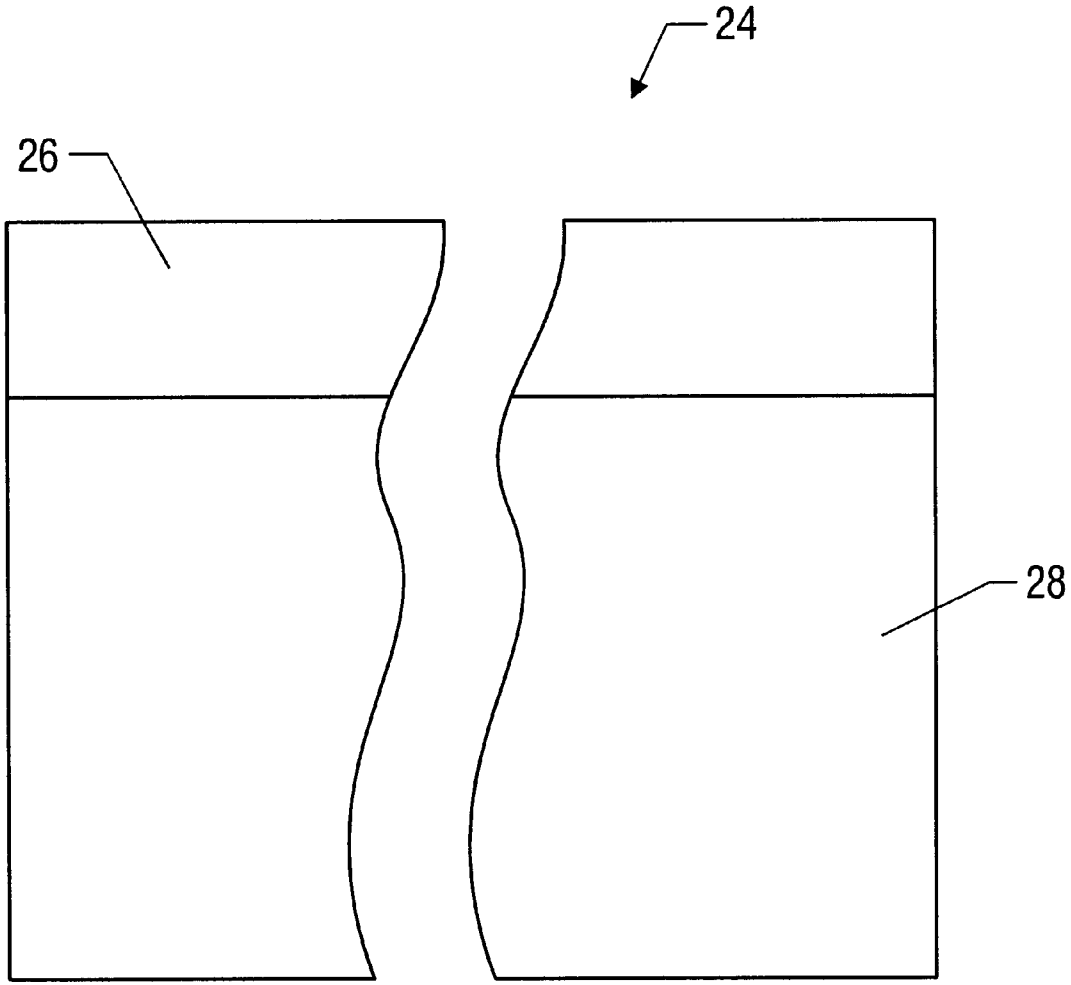
FIG. 4 is a front elevation view of an embodiment of the brush attachment.

FIG. 4 shows a brush attachment 24 which is comprised of a brush head 26 and a plurality of bristles 28. Brush head 26 has a length shorter than the length of bottom 8 of the nozzle housing 2, such that said brush attachment 24 can easily fit into said nozzle body 6. As shown in FIG. 5, attachment 24 may be made up of a plurality of bristles 28 which are wrapped around a centering piece 30 and held together by an elongated brush head 26. Brush head 26 is preferably made up of a solid material such as a polymer or metal, and is of a size such that it can easily be attached to and removed from snap 12.

Figure 6:
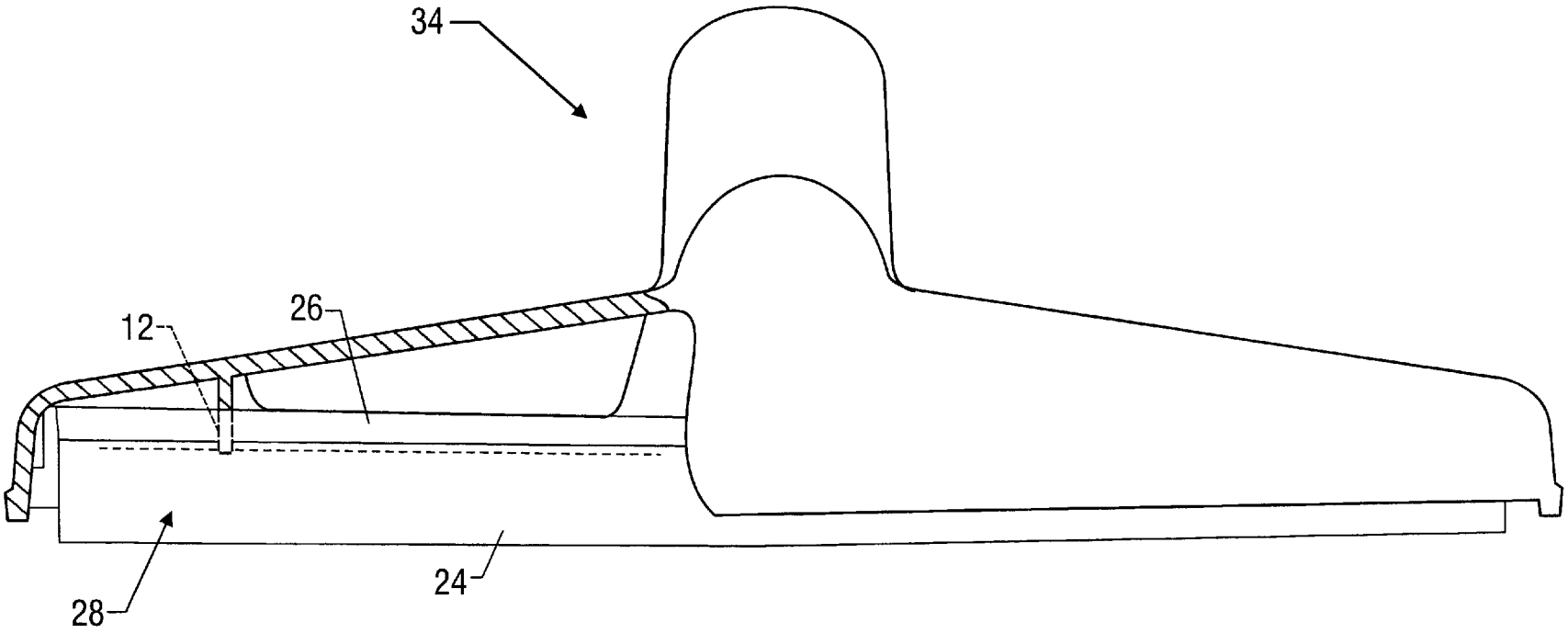
FIG. 6 is a front partial cutaway view of the nozzle housing in dry mode, showing the brush assembly inserted into the nozzle housing.

An embodiment of a multi-use floor tool configured as a dry nozzle assembly 34 is shown in FIG. 6, with brush head 26 inserted into snap 12 such that air flow is allowed around said brush attachment 24 and through said dry nozzle assembly 34, and preferably such that said bristles 28 protrude slightly out of the bottom of nozzle body 6.

Figure 7:
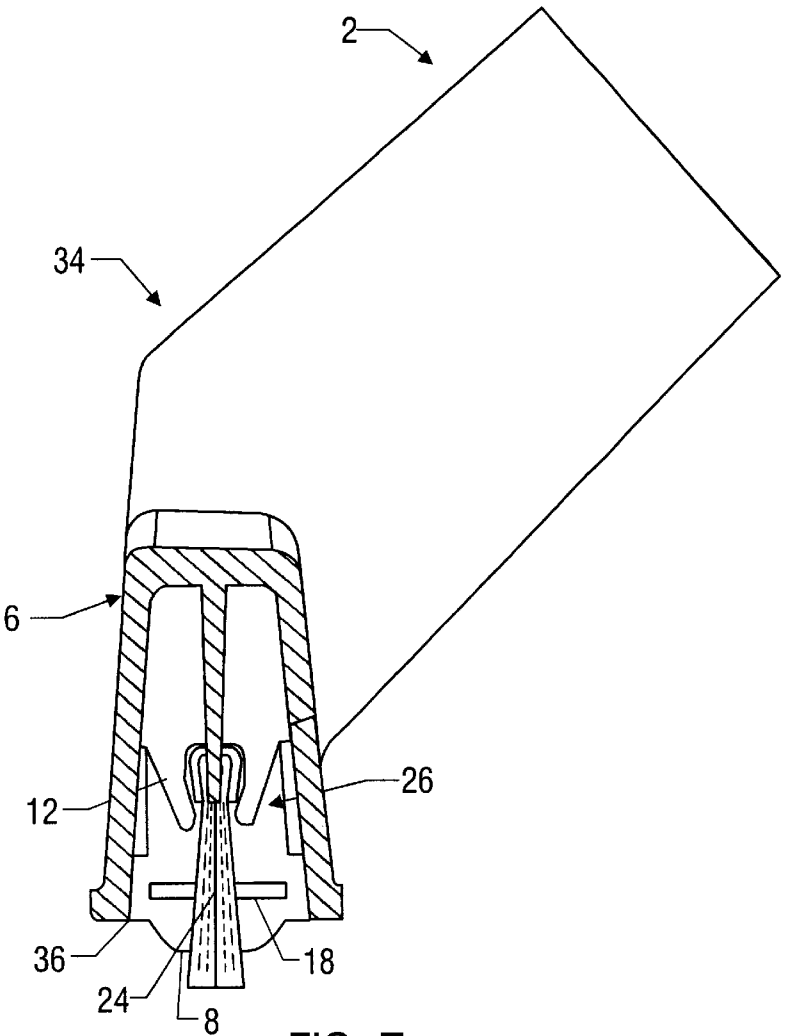
FIG. 7 is a side cross-sectional view of the nozzle in dry mode showing the brush attachment as inserted into the nozzle housing.

As shown in FIG. 7, dry nozzle assembly 34 is comprised of nozzle housing 2 having said brush attachment 24 attached to it by said snap 12. Brush attachment 24 is preferably affixed to snap 12 in such a way that brush head 26 can rotate within snap 12, around its own longitudinal axis. Such rotation is promoted by pushing or pulling said dry nozzle assembly 34 across the surface to be cleaned, which correspondingly rotates brush attachment 24 until bristles 28 touch the sides 36 of the bottom of the nozzle housing. When in this position, the full amount of air flow is allowed through the open part of nozzle bottom 8, and the opposite side is correspondingly blocked. The rotation of brush attachment 24 inside of nozzle housing 2 thus allows for cleaning using the full amount of air flow during both the push and pull cleaning motions.

Figure 8:
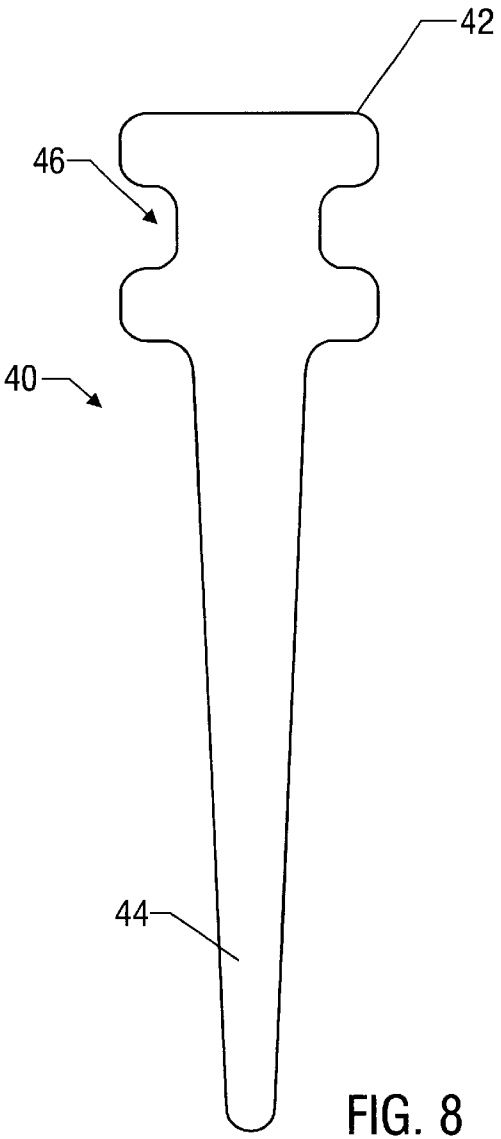
FIG. 8 is a side cross-sectional view of the squeegee attachment.

Shown in FIG. 8 is squeegee attachment 40, primarily used for wet operation. Squeegee attachment 40 is comprised of a squeegee head 42, with a squeegee body 44 protruding laterally from head 42. Squeegee attachment 40 has a length and width shorter than bottom 8 of said nozzle housing, such that the squeegee attachment 40 can easily fit into the bottom 8 of said nozzle housing. Squeegee attachment 40 may be suitably constructed of a rubber or polymer composition. Squeegee head 42 should also have a size such that it can be easily inserted and removed from snap 12. One such preferred shape of squeegee head 42 has a square cross-section with grooves 46 longitudinally placed along its sides, as shown in FIG. 8. Squeegee body 44 preferably has a length such that when attached, it protrudes from the bottom 8 of said nozzle housing so as to contact the surface being cleaned. It is also preferably constructed from a rubber or polymer composition which is resiliently flexible such that, during cleaning operation, squeegee body 44 is allowed to bend slightly when dragged against the surface being cleaned.

Figure 10:
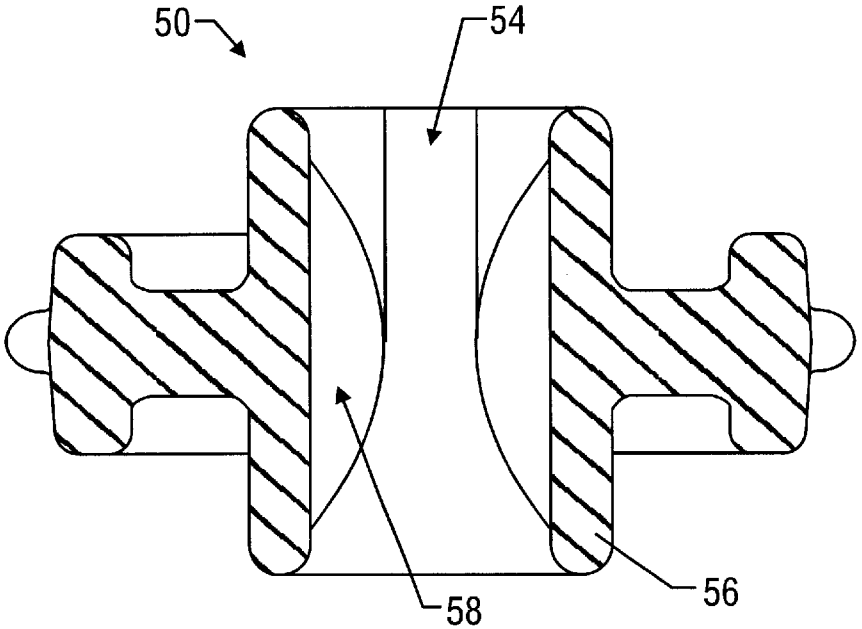
FIG. 10 is a side cross-sectional view of the nozzle insert.
Figure 11:
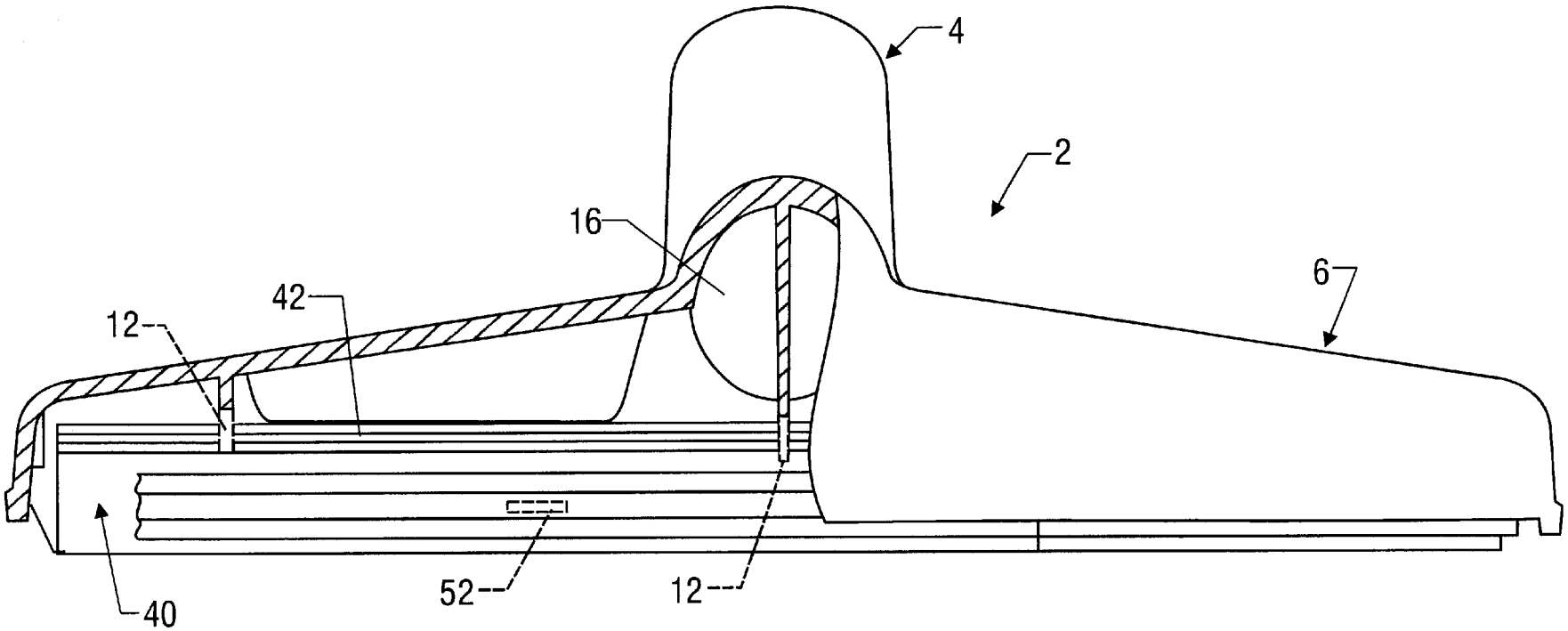
FIG. 11 is a front partial cutaway view of the nozzle housing in wet mode, showing both the squeegee attachment and nozzle insert attached to the nozzle housing.

When optimum wet operation is desired, a nozzle insert 50 (seen in FIGS. 9 and 10) is preferably attached to the bottom of nozzle body 6, as shown in FIG. 11. Nozzle insert 50 preferably is shaped such that it can fit easily into the bottom 8 of nozzle housing 2 but should be substantially the same shape as the nozzle housing's bottom opening 8 for most effective use. Nozzle insert 50 is preferably constructed of polymer material, and, in one embodiment shown in FIG. 9, comprises a plurality of tabs 52 along its outer edges. These tabs 52 correspond to recesses 18 inside of nozzle body 6 such that nozzle insert 50 can be attached to nozzle body 6 by snapping it into place. As an alternative embodiment, nozzle insert 50 can be formed to surround the bottom of nozzle housing 2 such that it fits snugly around and attaches to the nozzle housing without the use of tabs and recesses.

Figure 9:
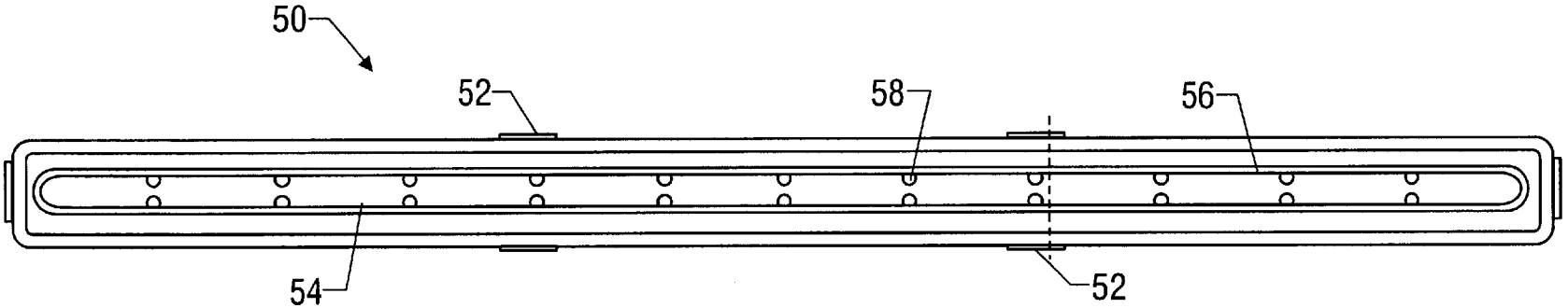
FIG. 9 is a bottom plan view of the nozzle insert.

As shown in FIGS. 9 and 10, nozzle insert 50 also contains an inner opening 54 through which air and other materials can pass. This inner opening 54 is bounded by an inner insert frame 56 upon which is preferably a plurality of lateral ridges 58. Opening 54 has a length and width satisfactory to allow squeegee body 44 to fit laterally through the inner opening 54 and preferably such that ridges 58 contact squeegee body 44. An embodiment of nozzle insert 50 is shown in FIG. 10, which demonstrates a preferred cross-sectional shape of the nozzle insert 50. When nozzle insert 50 is inserted into the nozzle housing 6, it provides the function of reducing the surface area through which materials can flow, and increasing suction pressure, resulting in more efficient suction of wet materials.

The multi-use floor tool configured as wet nozzle assembly 62, shown in FIG. 11, comprises nozzle housing 2 with both the squeegee attachment 40 and nozzle insert 50 attached to the nozzle housing. The squeegee head 42 is attached to the nozzle body 6 by snap 12. Nozzle insert 50 is also attached inside the bottom 8 of nozzle body 6.

Figure 12:
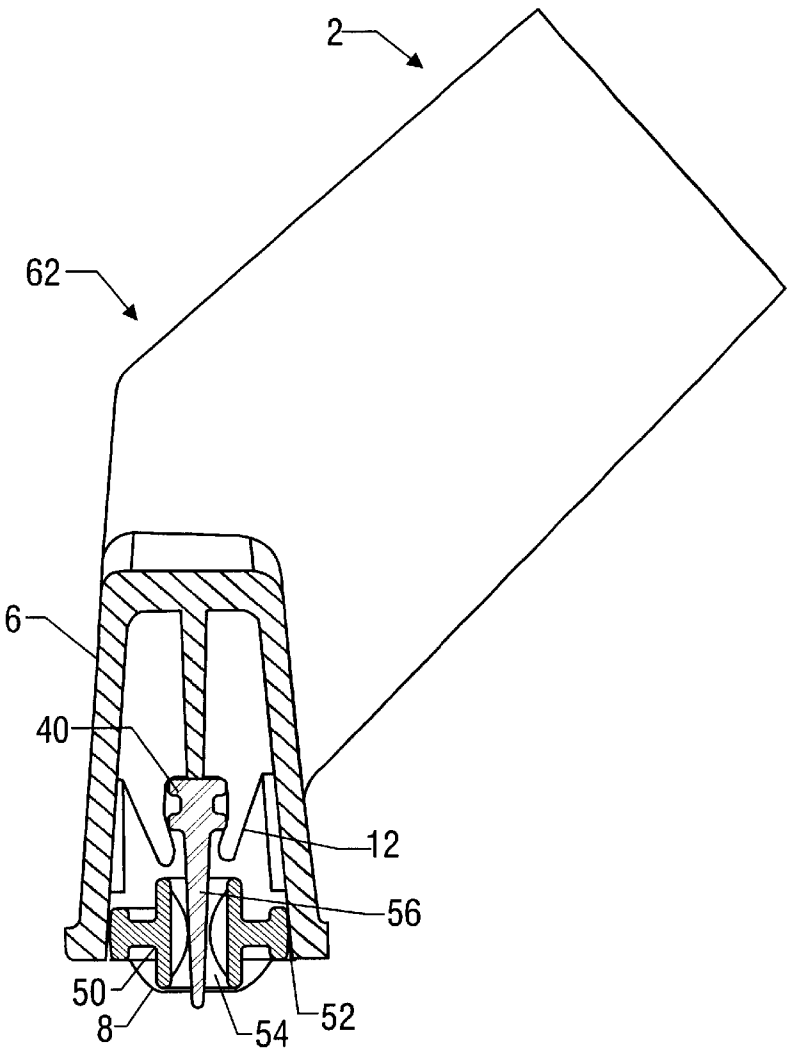
FIG. 12 is a side cross-sectional view of the nozzle in wet mode showing both the squeegee attachment and nozzle insert attached to the nozzle housing.

As shown in FIG. 12, squeegee body 44 preferably protrudes slightly from the bottom 8 of nozzle housing 2. The area of bottom opening 8 is also effectively reduced such that air and other materials are able to pass only through inner opening 54 of the insert nozzle 50. The effectiveness of wet suction can thereby be increased. Also, squeegee body 44 is preferably able to bend resiliently in order to more effectively promote the clean-up of wet materials.

Figure 13:
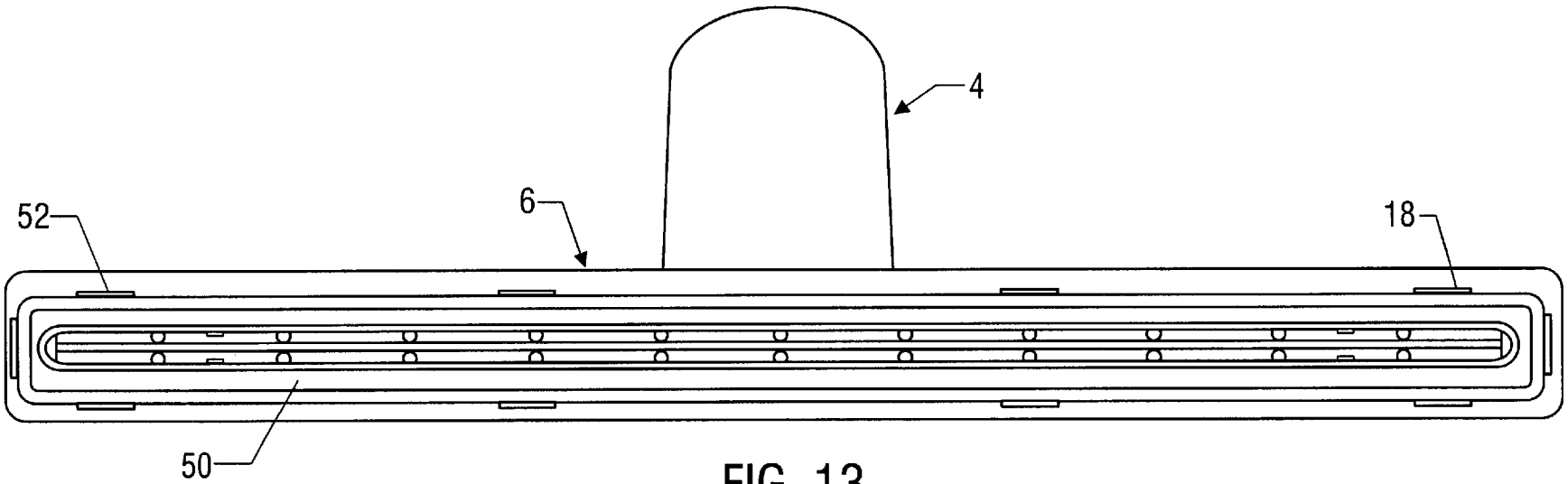
FIG. 13 is a bottom plan view of the nozzle housing in wet mode, showing the nozzle insert attached to the nozzle housing.

FIG. 13 shows a bottom view of nozzle insert 50 held inside nozzle body 6 by the plurality of tabs 52 along its sides. Said flaps correspond to the plurality of recesses 18 on the inside of the nozzle body 6.

Figure 14:
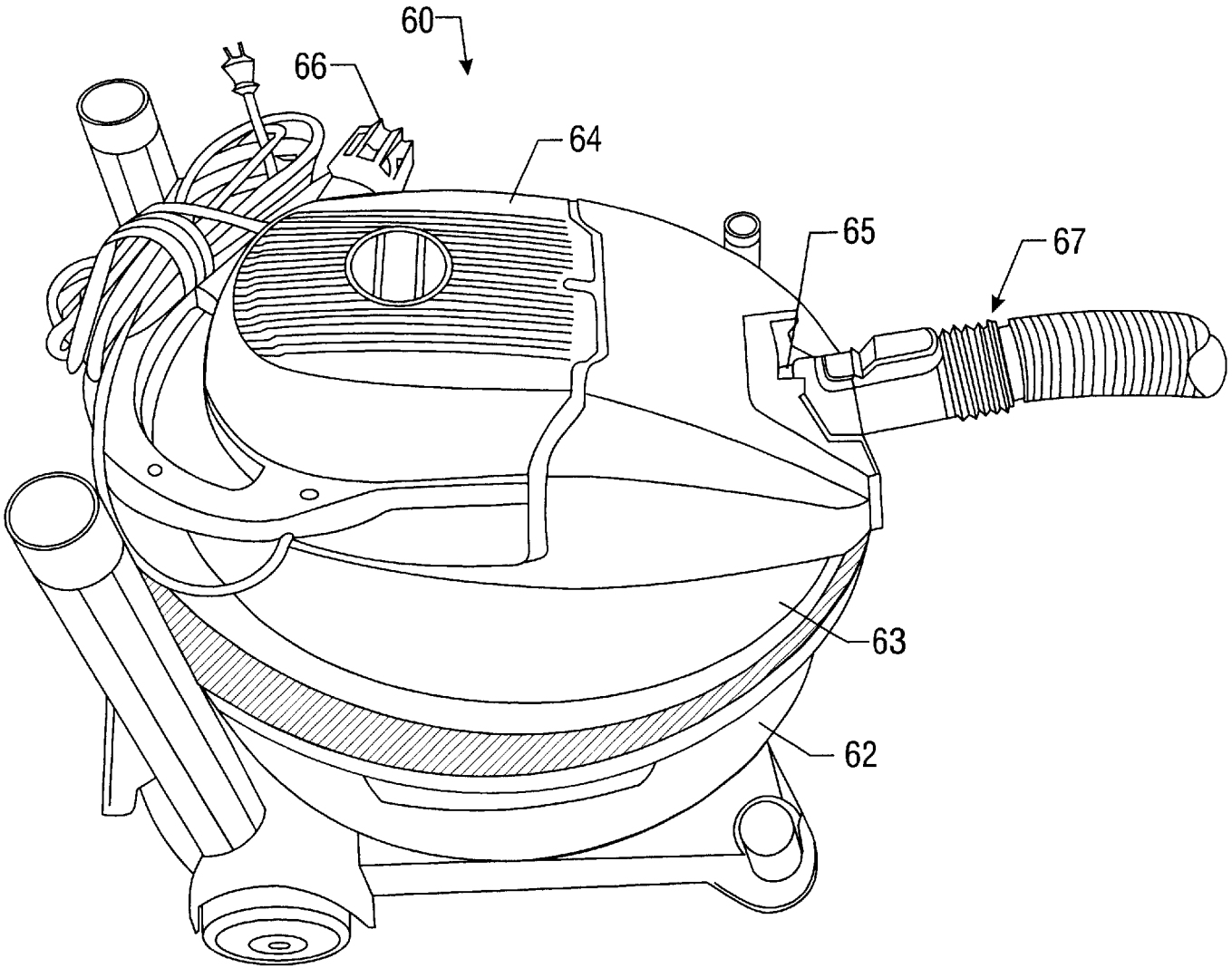
FIG. 14 is a front perspective view of a vacuum assembly incorporating the invention, as disclosed herein.

FIG. 14 shows a perspective view of an embodiment of the present invention employed on a vacuum 60. As will be appreciated by one skilled in the art with the benefit of this disclosure, the multi-use floor tool can be utilized on any such application. As shown in FIG. 14, vacuum 60 comprises a collection tub 62 having a lid 63 and a powerhead assembly 64. The collection tub 62 and the lid 63 are preferably made of injection-molded plastic, such as polypropylene or the like, in accordance with conventional practice.

In accordance with conventional designs, an air inlet port 65 is defined in the lid 63 or, alternatively, may be defined in a side wall of the collection tub 62. The powerhead assembly 64 houses a motor and impeller assembly, and has defined therein an air exhaust or outlet port 66. The powerhead assembly 64 is operable to create a suction within the collection tub 62, such that debris and/or liquid is drawn in to the collection tub 62 through the hose 67, which is attached to the inlet port 65. Multi-use floor tool (not shown) may be attached to hose 67 at an end opposite that attached to inlet port 65.

It will be readily understood by those skilled in the art having the benefit of this disclosure, that the multi-use floor tool provides distinct advantages over previous floor tools, such advantages including the following:

(a) The multi-use floor tool allows a vacuum operator to effectively perform both wet and dry cleaning using a single nozzle. The operator is able to easily attach and detach wet and dry cleaning attachments, depending on what type of use is desired, or to clean using the nozzle alone, with no attachments.

(b) The multi-use floor tool also provides increased effectiveness of dry vacuum operation by allowing full air-flow operation during both the push and pull cleaning motions. The brush attachment is allowed to rotate with each push and pull motion such that as the nozzle is moved along a cleaning surface, airflow is redirected to the side in which debris is being collected during that motion.

The present invention, therefore, is well adapted to carry out the objects and attain the ends and advantages mentioned, as well as others inherent therein. While presently preferred inventions have been given for the purpose of disclosure, numerous changes in the details of construction and arrangement of parts will be readily apparent to those skilled in the art, and are encompassed within the spirit of the invention and the scope of the appended claims.

What is claimed is:

1. A cleaning system comprising:

a brush attachment comprising a brush head and a brush body attached to the brush head;

a squeegee attachment comprising a squeegee head and a squeegee body attached to the squeegee head;

a nozzle housing having a first end adapted to be coupled to a vacuum device and a second end, the nozzle housing defining an air flow passage and having a plurality of extensions affixed inside of said housing along the nozzle housing's longitudinal center proximate the second end, the extensions interchangeably receiving one of the brush attachment such that at least a portion of the brush body extends from the second end for dry cleaning operations, or the squeegee attachment such that at least a portion of the squeegee body extends from the second end for wet cleaning operations; and a nozzle insert having an opening extending therethrough, the nozzle insert being removably attached to the second end of the nozzle housing such that the squeegee body extends through the opening.

2. A cleaning system comprising:

a brush attachment;

a squeegee attachment;

a nozzle housing having a first end adapted to be coupled to a vacuum device and a second end having a connector therein to interchangeably receive one of the brush attachment for dry cleaning operations or the squeegee attachment for wet cleaning operations; and a nozzle insert defining an opening extending therethrough, the nozzle insert being removably attachable to the second end of the nozzle housing and being substantially the same shape as the second end of the nozzle housing to be received thereby, and wherein the opening is shaped such that the squeegee body extends perpendicularly through the opening when the squeegee attachment and the nozzle insert are connected to the second end.

3. The cleaning system of claim 2, wherein the second end of the nozzle insert includes a plurality of tabs therein, and wherein the nozzle housing includes a plurality of corresponding recesses that engage the tabs to attach the nozzle it to the second end of the nozzle housing.

* * * * *